United States Patent [19]

Walther

[11] Patent Number: 4,759,397

[45] Date of Patent: Jul. 26, 1988

[54] LOUVRE BLIND GUIDE CARRIAGE

[75] Inventor: Pierre Walther, Chatillon, Switzerland

[73] Assignee: Syba Handels-und Vertriebs AG, Switzerland

[21] Appl. No.: 839,762

[22] Filed: Mar. 13, 1986

[30] Foreign Application Priority Data

Mar. 14, 1985 [DE] Fed. Rep. of Germany ..... 3509064

[51] Int. Cl.[4] ..... E06B 9/26

[52] U.S. Cl. ..... 160/166.1; 160/900; 160/176.1

[58] Field of Search ..... 160/166, 166 A, 176 R

[56] References Cited

U.S. PATENT DOCUMENTS

| | | | |
|---|---|---|---|
| 2,807,322 | 9/1957 | Toti | 160/176 |
| 2,809,693 | 10/1957 | Sharpe | 160/166 A |
| 3,298,425 | 1/1967 | Cayton et al. | 160/176 |
| 3,299,943 | 1/1967 | Poe | 160/176 |
| 3,860,056 | 1/1975 | Bruneau | 160/176 |
| 4,293,021 | 10/1981 | Arena | 160/166 A |
| 4,350,197 | 9/1982 | Haller | 160/166 A |

FOREIGN PATENT DOCUMENTS

| | | | |
|---|---|---|---|
| 1161356 | 1/1984 | Canada | 160/166 A |
| 2554351 | 6/1978 | Fed. Rep. of Germany . | |
| 2912257 | 10/1980 | Fed. Rep. of Germany | 160/166 A |
| 3105052 | 8/1982 | Fed. Rep. of Germany | 160/166 A |
| 2628162 | 11/1982 | Fed. Rep. of Germany . | |

*Primary Examiner*—Ramon S. Britts
*Assistant Examiner*—Blair Johnson
*Attorney, Agent, or Firm*—Renner, Otto, Boisselle & Lyon

[57] ABSTRACT

A guide carriage for a louvre blind has a bearing sleeve which is provided in a bushing forming part of a housing and in which a bearing pin is frictionally engaged, the bearing pin being provided at its lower end with a louvre holder for a vertical louvre. To provide a short distance between the louvre holder and the guide carriage, and simultaneously to provide simple removability of the louvre, the bearing pin is fixedly connected to the louvre holder, located in the bearing sleeve and may be removed from the sleeve simply by applying oppositely directed forces to the housing and the bearing pin along the axis of the pin.

10 Claims, 2 Drawing Sheets

LOUVRE BLIND GUIDE CARRIAGE

The present invention relates to a guide carriage for a louvre blind, with a housing having end walls extending transversely of the direction of movement of the carriage, sliding or running elements disposed laterally on the housing for displacement of the carriage in a support rail, a bearing sleeve rotatably mounted in a bushing, which bushing is fixed relative to the housing, the bearing sleeve having a pinion portion, a bearing pin frictionally engaged in the bearing sleeve and having a louvre holder arranged at a lower end of the bearing pin for holding a vertical louvre, and a worm gear rotatably mounted in openings in the end walls and meshing with a pinion portion of the bearing sleeve, the worm gear being formed with an opening shaped to receive a complementary driving shaft.

From German Patent Specifications Nos. 2,554,351 and 2,628,162, guide carriages of this type are known, in which the bearing pins are non-releasably engaged in the bearing sleeves. In order, for example, for cleaning purposes, to be able nevertheless to remove the louvres, a hook is formed at the lower end of the rotary pin and the louvre holder has a corresponding eye for releasable suspension from the hook. The relatively large construction length of the hook-eye connection, allows undesirable entry of light between the end of the louvre and the carriage, even when the blind is closed, is a disadvantage of this arrangement. Furthermore, the louvres, in order to be removed, must be released upwardly from the hooks; the louvres cannot be removed from the guide carriages by tension forces, so that the danger of an accident resulting from a person or object hanging from the louvres is increased.

It is an object of the present invention, in contrast thereto, to provide a guide carriage of the initially described kind in which the space between the guide carriage and the louvre is reduced and in which the louvres can be readily attached and removed by compressive and tensile forces, respectively, applied along the axis of the bearing pin.

According to the present invention, the bearing pin may be installed in and removed from the louvre holder and is the bearing sleeve merely by the application of forces to the pin along its axis.

The advantage of the present invention lies, in particular, in that a rigid, fixed connection is provided between the bearing pin and the louvre holder whereby the distance required between the guide carriage and the louvre holder is substantially reduced. Consequently the amount of desired entering light at this position, is substantially reduced. Removal of the louvre from the guide carriage is particularly simply and advantageously accomplished in the invention because the bearing pin is mounted in the bearing sleeve with a detent engagement that is releasable by axial forces. In this way, the danger of an accident is considerably reduced, since the louvres can be automatically released from the guide carriage in response to tension forces. This is particularly important when, for example, people hang or fall on the louvres, etc.

It is particularly advantageous for the bearing pin to be formed integrally with the louvre holder. The bearing sleeve has axially extending detent springs that project radially into a complementary peripheral groove in the bearing pin. There is no horizontal support edge between the detent springs and the peripheral groove of the bearing pin, instead, complementary oblique sliding surfaces extend outwardly from the bearing pin and the detent springs. As a result a predetermined, sufficient axial pull on the bearing pin spreads the detent springs of the bearing sleeve upwardly and takes them out of engagement with the peripheral groove in the bearing pin so that the bearing pin can be withdrawn from the bearing sleeve.

The detent springs are preferably arranged at the upper end of the bearing sleeve, above the pinion portion. The bearing pin, which is formed perpendicularly to the length of the horizontal louvre holder, projects through the bearing sleeve and is provided with the complementary, peripheral groove to engage the detent springs. Alternatively, however, the detent springs can be provided at any position on the bearing sleeve. The free ends of the detent springs and the peripheral groove of the bearing pin have complementary shapes and are so dimensioned that they are urged together with a predetermined radial pressure. In this way, the bearing pin and the bearing sleeve form a frictional coupling having a predetermined frictional resistance to applied moment forces. The louvres cannot be rotated without overcoming that frictional resistance in the rotary bearing formed by the bearing sleeve and the bearing pin.

Alternatively, the detent springs can be provided at any position on the bearing sleeve.

It may alternatively be advantageous to provide the bearing sleeve with the shaped peripheral groove and to provide the bearing pin with corresponding detent projections, which engage with a predetermined radial pressure in the peripheral groove.

The invention will be more readily understood from the following description of preferred embodiments thereof given, by way of example, with reference to the accompanying drawings, in which:

FIG. 4 shows a top view of the guide carriage of FIGS. 1 and 3 in the absence of a support rail.

Figure 1:
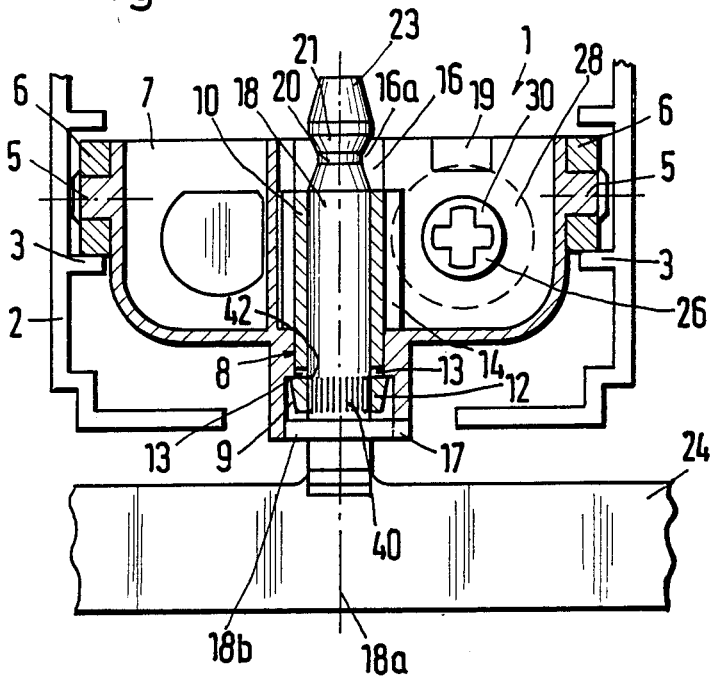
FIG. 1 shows a view taken in cross-section along lines 1—1 of FIG. 4 through a guide carriage according to a first embodiment of the invention.
Figure 2:
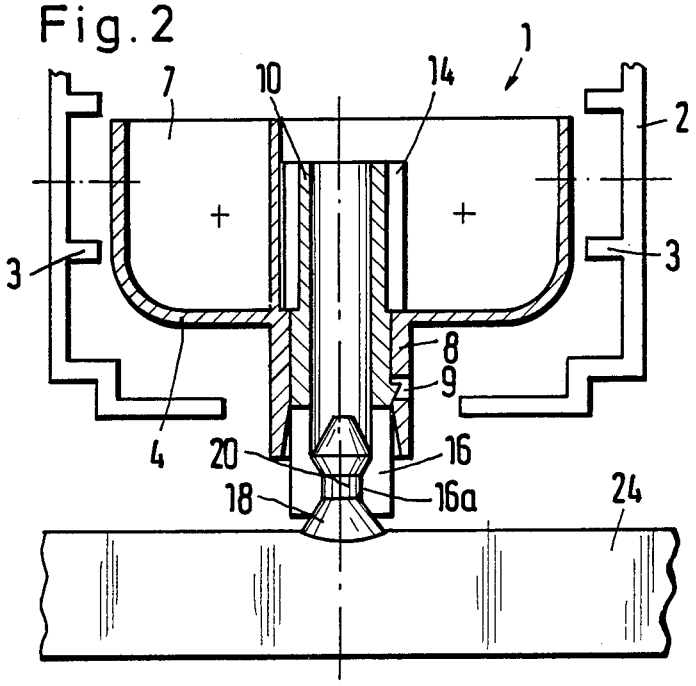
FIG. 2 shows a view taken in cross-section through a second embodiment of the guide carriage.
Figure 3:
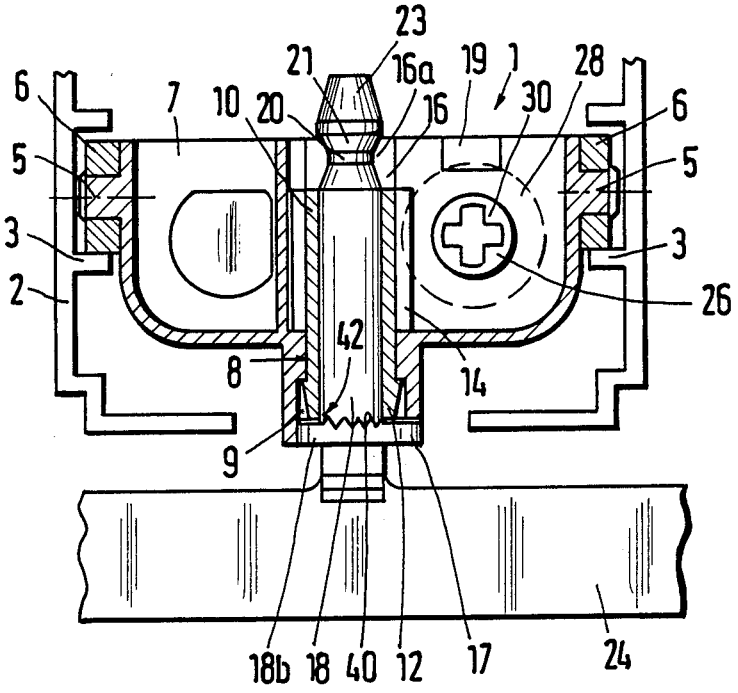
FIG. 3 shows a cross-section through a modification of the embodiment of the guide carriage according to FIG. 1.

FIGS. 1 and 2 show views taken in cross-section through first and second embodiments of the guide carriage according to the present invention. FIG. 4 shows a top view of each of those guide carriage embodiments, but not mounted in a carriage rail. In FIGS. 1, 2 and 3, the bearing pins in the guide carriages are not sectioned. In FIG. 4, the guide carriage of FIGS. 1 and 3 is shown in a top view. Like elements are given the same reference numbers in all figures. The guide carriage comprises a substantially rectangularly shaped housing 4, which at two opposite sides has outwardly extending stub shafts 5, on which running rollers 6 are journalled. Rollers 6 bear on and move along the running surfaces 3 of a support rail 2 for low friction displacement of the guide carriage 1 along the support rail 2.

The housing of the guide carriage 1 comprises a vertically directed housing bushing 8, which is located centrally between the running rollers 6 and which is directed perpendicular to the axis of the running rollers, and, in the illustrated embodiment, to openings 9. A bearing sleeve 10 is rotatably mounted in the housing bushing 8. Bearing sleeve 10 has detent projections 12 at its lower end which project into the detent openings 9 in the housing bushing 8. The bearing sleeve 10 has a bearing portion 11 installed in the housing bushing 8 for rotatable mounting of the bearing sleeve 10 in the housing bushing 8. Adjoining the bearing portion 11, bearing sleeve 10 has a pinion portion 14, at which the bearing sleeve 10 has, at its outer periphery, a toothed pinion with the teeth extending upwardly along axis 18*a* of rotation of bearing sleeve 10 at an inclination. The pinion portion 14 extends to detent springs 16, which have inwardly radially extending portions 16*a*.

Within the bearing sleeve 10, a leaving pin 18 is rotatably mounted. The lower end of pin 18 is fixedly connected to a horizontal louvre holder 24 and, for example, can be formed integrally with this louvre holder 24. The bearing pin 18 has a peripheral groove 20 disposed at the position of the detent springs 16. Groove 20 has inclined side walls which the radially inwardly extending portions 16*a* of the detent springs engage, advantageously in a form-fitting manner. The detent springs 16 and the peripheral groove 20 are so dimensioned that, when the detent connection has been made, the radially inward pressure acts so as to produce a desired friction between the bearing sleeve and the bearing pin. As a result of this friction the bearing pin 18 is rotated by the turning of bearing sleeve 10 until an abutment 17, which is formed on a lower annular collar portion 18*b* of the bearing pin 18, abuts a counter-abutment depending from the housing 4. If the rotary movement of the pinion and the bearing sleeve 10 is then continued, then the bearing sleeve 10 slips with respect to pin 18 by overcoming the frictional resistance between the detent springs 16 and the peripheral groove 20. Bearing sleeve 10 then rotates freely on the bearing pin 18, which is restrained from turning by the abutment 11. The detent connection formed by the detent springs 16 of the bearing sleeve 10 and the peripheral groove 20 of the bearing pin 18 thus acts as a friction coupling or clutch. The formation of the friction coupling integrally with the direct connection is particularly advantageous.

The housing walls carrying the stub shafts 5 are connected together by two end walls extending at a small spacing from one another, one of which is indicated by reference numeral 7. Between the end walls a worm gear 26 is rotatably mounted, which has a worm thread 28, which meshes with the pinion portion 14 of the bearing sleeve 10. The worm gear 26 has an inner shaped opening 30, which is complementary to the shape of a turning shaft (not shown), which extends through a number of the guide carriages. On being rotated the shaft, rotates the worm gear 26, which through the meshing of its worm thread with the pinion portion 14 and the frictional connection between the detent springs 16 and the peripheral groove 20 rotates pin 18 and louvre holder 24 to alter the position of the vertical louvre in a desired manner.

In FIG. 2, the housing 4 of the carriage is shown within the support rail 2, the lateral slide or roller elements 6 and the worm gear 26 being omitted in order to facilitate the illustration of the apparatus. The housing bushing 8 is formed centrally and vertically directed on the housing 4 and has a detent opening 9 and a downwardly slightly conically divergent inner surface. In the housing bushing 8, the bearing sleeve 10 is located by means of, for example, a projection on the bearing sleeve 10 engaging in the detent opening 9. The pinion section 14 is disposed above the housing bushing 8. The bearing sleeve 10 has at its lower end detent springs 16 with radially inwardly extending portions 16*a*, which engage a complementary peripheral groove 20 in the bearing pin 18. Bearing pin 18 is formed in one piece with the horizontal louvre holder 24.

The peripheral groove 20 of the bearing pin 18 has oblique side surfaces 21 which extend radially at an inclination to the axis of pin 18 and which make the peripheral groove 20 wider as the distance from the pin axis 18*a* increases. If, therefore, a sufficient axial force acts on the bearing pin 18 along its axis, i.e. outwardly from housing 4 toward louvre holder 24, then the detent springs 16 are deflected outwardly by the side surfaces 21, to release bearing pin 18 from the detent connection. In this way bearing pin 18 can be withdrawn axially from the bearing sleeve 10.

For insertion, the bearing pin 18 is pushed from louvre holder 24 toward housing 4 into the bearing sleeve 10, until a tapered tip 23 of the bearing pin abuts the detent springs 16 and deflects them outwardly. Upon continued upward movement of bearing pin 18, the detent springs 16 fall into the peripheral groove 20 of the bearing pin 18, so that the detent connection is produced.

According to FIGS. 1 and 3, interengaged alternating tooth and recess milling 40 and 42 are provided between the bearing pin 18 and the bearing sleeve 10. These teeth and recesses cause the rotation of the bearing pin 18 to begin once a predetermined minimum torque is reached. In this way, undesired accidental rotation of the vertical louvre in the carriage is prevented. According to FIG. 1, milling 40 comprising axially disposed, alternating raised portions and recesses is provided on the periphery of the bearing pin 18. In the bearing sleeve 10, resilient detent members are provided, for example on the detent projections 12, which are radially inwardly directed and carry milling 42 engaging the milling 40.

FIG. 3 shows a carriage guide embodiment similar to that of FIG. 1, except that the milling 40 is applied on the upper surface of an annular collar 18*b*. Collar 18*b* is formed at a predetermined spacing from the louvre holder 24 on the bearing pin 18 and which also carries the abutments 17. In this embodiment, corresponding milling projections 42 are formed at the undersurface of the bearing sleeve 10, which co-operate with the milling 40 of the bearing pin 18.

I claim:

1. A guide carriage for a louvre blind, comprising:

a housing having end walls extending transversely of the direction of movement of said carriage;

sliding or running elements disposed laterally on said housing for displacement of said carriage in a support rail;

a bushing disposed within and fixed relative to said housing;

a tubular bearing sleeve having opposed first and second ends, said sleeve being rotatably mounted in said bushing so as to rotate about an axis, said bearing sleeve having a pinion portion and a detent portion including detent means, said detent means comprising at least two radial slots extending to said first end to define detent springs for yielding in response to radially outwardly directed forces and first and second opposing, oblique surfaces disposed on the inside of said sleeve on said springs for producing a radially outward force in response to forces applied to said oblique surfaces in either direction along said axis;

a worm gear rotatably mounted in openings in said end walls and meshing with said pinion portion of said bearing sleeve, said worm gear being formed with an opening shaped to receive a complementary turning shaft; and a bearing pin rotatably mountable in and demountable from said sleeve for rotation about said axis and including: (i) detent engaging means for engaging said detent means of said bearing sleeve and for releasing engagement with said detent means solely in response to forces applied along said axis, said detent engaging means comprising a first end and a peripheral groove having facing first and second surfaces formed in said pin which receive said first and second oblique surfaces on said springs and which also apply an axial force to at least one of said first and second oblique surfaces on said bearing sleeve in response to an axial force applied to a said pin mounted in said sleeve to demount said pin from said sleeve; and (ii) a louvre holder disposed at a second end of said pin.

2. A guide carriage as claimed in claim 1, wherein said bearing pin is formed in one piece with said louvre holder.

3. A guide carriage as claimed in claim 1, wherein said first and second bearing sleeve oblique surfaces are disposed at said first end of said bearing sleeve adjacent said pinion portion.

4. A guide carriage as claimed in claim 1, wherein said first and second bearing sleeve oblique surfaces are disposed at said second end of said bearing sleeve opposite said pinion portion.

5. A guide carriage as claimed in claim 1, wherein said first and second bearing sleeve oblique surfaces and said first and second groove surfaces are complementary for mutual engagement as a frictional clutch.

6. A guide carriage as claimed in claim 1, wherein said bearing sleeve includes radially outward projections for unreleasably locating said sleeve in said housing.

7. A guide carriage as claimed in claim 1, wherein an annular collar is formed on said bearing pin spaced from said louvre holder, said collar carrying an abutment for contacting a counter-abutment fixed relative to said housing.

8. A guide carriage as claimed in claim 1, wherein said detent means includes four radial slots to define four detent springs.

9. A guide carriage as claimed in claim 1, wherein the first end of the detent engaging means is tapered.

10. A guide carriage as claimed in claim 1, wherein the facing first and second surfaces of the peripheral groove in said pin are oblique.

* * * * *